United States Patent [19]

Barrett et al.

[11] Patent Number: 4,660,366

[45] Date of Patent: Apr. 28, 1987

[54] FRICTION SPINNING APPARATUS

[75] Inventors: Michael Barrett, Rossendale; William A. Tattersall, Accrington; Dennis O'Donnell, Oldham, all of England

[73] Assignee: Hollingsworth (UK) Limited, Accrington, England

[21] Appl. No.: 783,302

[22] Filed: Oct. 2, 1985

[30] Foreign Application Priority Data

Oct. 3, 1984 [GB] United Kingdom ..... 8424993

[51] Int. Cl.[4] ..... D01H 7/885; D01H 15/02

[52] U.S. Cl. ..... 57/263; 57/401

[58] Field of Search ..... 57/401, 263

[56] References Cited

U.S. PATENT DOCUMENTS

| | | | |
|---|---|---|---|
| 4,367,623 | 1/1983 | Parker et al. | 57/263 |
| 4,380,892 | 4/1983 | Parker et al. | 57/263 X |
| 4,541,233 | 9/1985 | Raasch et al. | 57/263 |

*Primary Examiner*—Stuart S. Levy
*Assistant Examiner*—Joseph J. Hail, III
*Attorney, Agent, or Firm*—Cort Flint

[57] ABSTRACT

A friction spinning apparatus includes a yarn winder and a pair of friction spinning rollers of which one is perforated and provided with a suction slot which is opened and closed on rotation of a piecing lever, means being provided for interconnecting operation of the piecing lever with, on the one hand, restoration of the winding operation and, on the other hand, restoration of fiber feed to the nip between the two friction spinning rollers.

Preferably the interconnecting means comprise a pair of cams on the drive shaft linked to the piecing lever and co-operable with respective switches to control drive to the fiber feed roller of the fiber-opening unit and also the package lift mechansim to initiate winding.

8 Claims, 4 Drawing Figures

FRICTION SPINNING APPARATUS

BACKGROUND OF THE INVENTION

The present invention relates to piecing friction spinning apparatus.

PRIOR ART

European Patent Specification No. 0 052 412 discloses a method of piecing in which the rotation of an inner sleeve or baffle within a perforated friction spinning roller effects opening of the suction slot to apply suction at the nip between the two friction spinning rollers along the yarn formation region.

Rotation of that baffle needs to be carefully timed in relation to (a) the initiation of fiber feed to the beater and (b) the start of the winding operation so that the fibre feed arrives at the yarn formation region correctly timed relative to the start of winding, in order to allow the first few fibers to attach to the retracting seed yarn to be drawn through the doffing tube, since the yarn withdrawal is itself activated by the resumed package rotation. Furthermore, since Published European Patent Specification No. 0 052 412 also discloses a pre-piecing phase in which suction is progressively cut off along the slot in order to draw the seed yarn along the spinning chamber, the restoration of primary spinning suction to the suction slot too soon would negate the advantage of the progressive suction slot blanking off in the pre-piecing phase (to induce movement of the seed end through the doffing tube and along the yarn formation region), and since the application of suction too late will result in fibres landing in regions remote from the nip between the two friction spinning rollers and thereby clogging the entire friction spinning chamber, the timing of the restoration of suction in relation to the initiation of the winding operation is also critical.

OBJECT OF THE INVENTION

Whereas previously timing of the restoration has been decided as a result of the skill of the operator of the friction spinner, it is an object of this invention to provide a semi-automatic piecing system independent of operator skill.

SUMMARY OF THE INVENTION

The present invention provides a friction spinning machine having at least one friction spinning station comprising: co-operating friction spinning rollers, at least one of the rollers being perforated; means for applying suction internally of said at least one perforated friction spinning roller; a winding station arranged to receive yarn spun in the nip between the friction spinning rollers at said friction spinning station; means for opening and closing a suction slot within said at least one perforated friction spinning roller; a fiber-opening unit for opening fibers and delivering them to the nip between said friction spinning rollers; and means for operably interconnecting the suction slot opening and closing unit, the winding station and the fiber-opening unit for ensuring that manual operation of a control to initiate operation of any one of these three components effects additionally initiation of operation of the other two of these components in the desired sequence and with a required relative timing for satisfactory piecing.

Preferably the opening and closing of the suction slot is controlled manually and the interconnecting means effects initiation of operation of both the winding station and the fiber feed in response to the degree of opening of the suction slot.

More preferably, the winding operation is initiated by lowering the package onto a rotating drive roll and interconnecting means links the manual control for opening the suction slot and the package lowering mechanism.

BRIEF DESCRIPTION OF THE DRAWINGS

In order that the present invention may more readily be understood the following description is given, merely by way of example, with reference to the accompanying drawings in which.

DESCRIPTION OF THE PREFERRED EMBODIMENT

Figure 1:
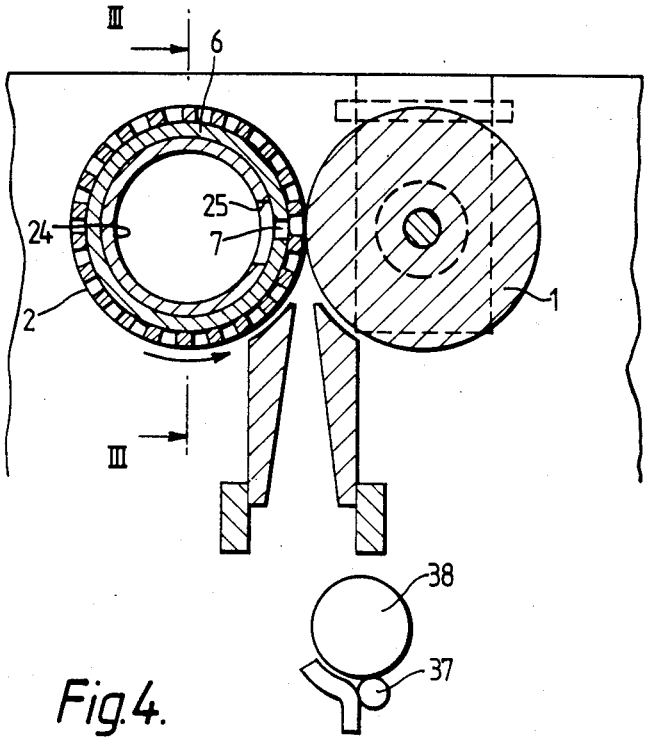
FIG. 1 is an end elevational view, partly in section, of a friction spinning station incorporating the present invention.
Figure 4:
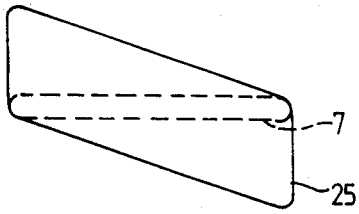
FIG. 4 is a detail of FIG. 3 showing the masking slot for ensuring progressive opening of the suction slot of the inner sleeve of the perforated roller.

The apparatus illustrated in FIGS. 1 to 4 is only slightly modified from that illustrated in our Published European Patent Application No. 0 052 412, the disclosure of which is incorporated herein by reference. Only sufficient detail of the apparatus of the earlier application will be described herein for exemplifying the improvements of this invention.

In particular, the apparatus illustrated in Published European Patent Application No. 0 052 412 shows a perforated roller 2 and a solid roller 1 operating alongside one another, with a baffle 6 defining a suction slot 7 very closely within the perforated roller 2, and a baffle 24 defining a masking slot 25 positioned closely within the cylindrical baffle 6. Rotation of innermost cylindrical baffle 24 defining the masking slot 25 is effected by means of a piercing lever 28 on a drive shaft 27 connected to the baffle 24.

Figure 2:
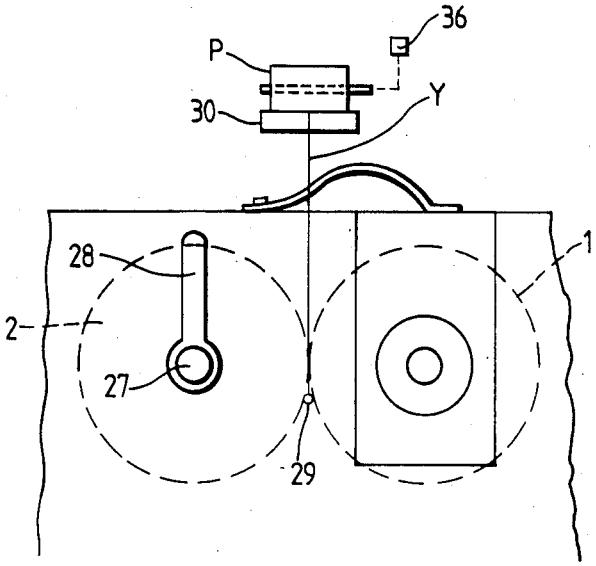
FIG. 2 is a view similar to FIG. 1, but showing the exterior of the machine and additionally illustrating the winding station.
Figure 3:
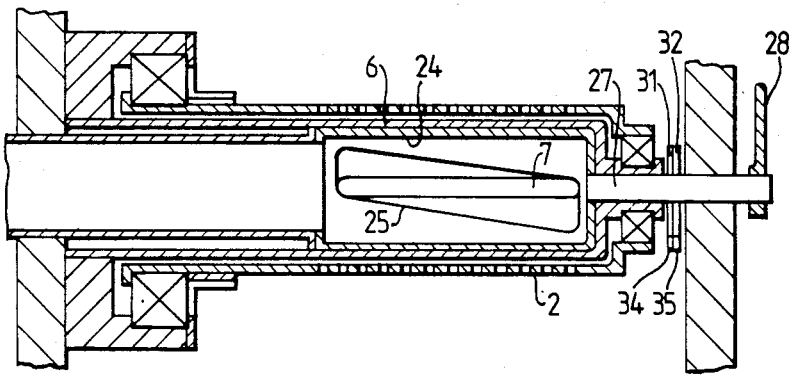
FIG. 3 is a side elevational view showing the detail of the interior of the perforated roller shown in FIGS. 1 and 2.

FIG. 2 of the present application shows the yarn Y leaving a doffing tube 29 and passing upwardly towards a winding station at which a package P of yarn rests on a winding roller 30 and is frictionally driven thereby for rotation such that the yarn passing over the package drive roller 30 and into the nip between the package P and the roller 30 becomes wound on the package P. Traversing of the yarn is effected by a conventional traversing mechanism (not shown).

When piercing is required, various functions are initiated, as shown in the following description which starts from a configuration after the friction spinning chamber has been cleared of any debris from previous spinning operations. This clearing operation is clearly illustrated and claimed in our Published European Patent Application No. 0 052 412. That cleaning operation is achieved by separating the solid roller 1 and the perforated roller 2 and rotating the piercing lever 28 in the anti-clockwise direction.

In order to prepare the apparatus for piercing up, the two friction spinning rollers 1 and 2 will be in their nip-defining configuration and the lever 28 is moved in the clockwise direction against spring-biasing, thereby progressively shutting off the suction slot 7 starting from the end nearer the piercing lever 28 and ending in a position where the end of the suction slot 7 remote from the lever 28 is exposed to suction. During this pre-piecing clockwise rotation of the lever 28, the end of the seed yarn for piercing, withdrawn from the package P, is introduced into the doffing tube 29 and the progressive suction shut-off will draw the yarn along the length of the yarn formation line. To allow this introduction of yarn to the doffing tube 29, the package P remains clear of the drive roller 30 (and indeed it will have been clear of that roller during the earlier part of the piecing and cleaning operation in order to allow the loose end of the yarn to be found from the package).

As the piecing lever 28 is released from this clockwise-rotated position the suction slot 7 is opened along its full extent (although in a very rapid operation which spreads the influence of the suction from the end furthest away from the lever 28 until eventually the entire slot length is opened), and during this motion of the lever 28 and of the inner baffle 24 two cams 31 and 32 fast on the drive shaft 27 rotate in the anti-clockwise direction and cause respective switches 34 and 35 to trip in order, on the one hand, to energise a clutch to drive the conventional fiber feed roller 37 to beater roll 38 of the fibre opening unit and, on the other hand, to de-energise the package-lifting solenoid 36 (FIG. 2) which until that moment holds the package P clear of the friction drive roller 30.

The angular positioning of the two cams 31 and 32 can be varied in order to adjust for variables such as the yarn count being spun, or differences in the friction on the package lifting mechanism which might result in a slightly later contact of the package P with the drive roll 30. It is thus possible to adjust the timing of either or both of the cams 31 and 32 in relation to the rotation of the drive shaft 27, and for this purpose the cams may be marked with indicia to facilitate adjustment.

From the above, it will be appreciated that the friction spinning station illustrated is capable of a piecing-up operation which is virtually independent of the skill of the operative and yet which is much simpler and cheaper than the fully automatic type of spinning machine in which a doffer robot will first of all arrive at the spinning station and exchange the full package for an empty package support tube, and later a piecer-cleaner robot will attend on that spinning station (or will separately arrive at the spinning station if there has been an end break before completion of the package build-up), and the operations of cleaning the friction spinning chamber and of piecing up are carried out fully automatically. The relatively cheap and simple apparatus provided for by the present invention can be adjusted to accommodate various variable parameters of the spinning operation and allows the operative to effect piecing-up without the need to lift and lower the package manually, and without the need to start the fibre feed manually.

Although the above description refers to manual operation of the blanking baffle 24 and automatic initiation of the package winding operation (by lowering of the package) and of the fibre feed, it will of course be understood that either the package lowering or the fiber feed initiation can be the manually effected variable, in which case a suitable timing system may be needed for linking the three functions in such a way that the operator is capable of carrying out those three operations singlehandedly while introducing the seeding end of the yarn into the doffing tube 29.

Throughout the above description we have referred to one of the two rollers as being perforated, but it will of course be understood that the same principles of the present invention may be applied where both rollers are perforated. Likewise, although parallel cylindrical rollers have been illustrated, there are various other possibilities, for example hyperboloidal rollers, as is well known in the art.

Furthermore, although the description of the present invention refers throughout to the type of suction slot closing and opening action illustrated in these drawings and also in our Published European Patent Application No. 0 052 412, the piecing system offered may readily be incorporated in a friction spinning apparatus in which an alternative form of suction cut-off and restoration mechanism is employed.

We claim:

1. A friction spinning machine having at least one friction spinning station comprising:

(a) cooperating first and second friction spinning rollers, at least said first friction spinning roller being perforated;

(b) means for applying suction internally of said perforated first friction spinning roller;

(c) winding means supporting a yarn package to be wound after being spun in the nip between said first and second friction spinning rollers;

(d) a driven package drive roll for frictionally engaging a said yarn package;

(e) means for lifting and lowering the yarn package, from and into contact with said package drive roll, whereby winding ceases when the yarn package is lifted clear of the package drive roll, and is restarted when the package is lowered onto the package drive roll;

(f) means defining a suction slot within said at least one perforated friction spinning roller;

(g) means for opening and closing said suction slot;

(h) a fiber opening unit for opening fibers and delivering them to the nip between said friction spinning rollers, said fiber opening unit having a feed roller;

(i) means for controlling operation of said fiber opening unit; and (j) manual control means for initiating spinning operation and piecing; the improvement comprising:

(k) means operably interconnecting the suction slot opening and closing means, the winding means and the fiber opening unit in a manner that manual operation of said manual control means to initiate operation of one of said suction slot opening and closing means, winding means, or fiber opening unit additionally initiates operation of the other two of said suction slot opening and closing means, winding means, or fiber opening unit in a desired sequence and with a required relative timing for satisfactory piecing, wherein said interconnecting means comprises a drive shaft operably connected to the means for opening and closing the suction slot within said at least one perforated roller; first and second cams mounted on said drive shaft; and first and second switches cooperable with said cams for initiating operation of both said fiber opening unit feed roller and said means for lifting and lowering said yarn package, whereby operation of said first switch initiates lowering of the package, and operation of said second switch initiates rotation of the fiber feed roller of said fiber opening unit, in the desired timing in relation to opening of the suction slot.

2. Friction spinning apparatus according to claim 1, wherein said manual control means comprises a manually-operable control for opening and closing said suction slot within the perforated first roller, and wherein said interconnecting means links operation of the means for opening and closing the suction slot and of the feed roller of said fiber-opening unit, with operation of said manually operable control.

3. Friction spinning apparatus according to claim 2, wherein said perforated first roller includes a rotatable baffle within a fixed baffle of the perforated first friction spinning roller, and wherein said means for opening and closing the suction slot comprises means defining a parallelogram-shaped slot in said rotatable baffle.

4. Friction spinning apparatus according to claim 1, wherein said second friction spinning roller is imperforate.

5. Friction spinning apparatus according to claim 1, wherein the winding station comprises a driven package drive roll for frictionally engaging a package, and means for lifting and lowering the package, from and into contact with said package drive roll, whereby winding ceases when the package is lifted clear of the drive roll, and is re-started when the package is lowered onto the drive roll.

6. Friction spinning apparatus according to claim 1, and including means for adjusting the positioning of said cams independently of one another, in relation to said drive shaft on which they are mounted.

7. Friction spinning apparatus according to claim 1, wherein said manually operable control comprises a lever fast on said drive shaft.

8. A friction spinning machine having at least one friction spinning station comprising:

(a) cooperating first and second friction spinning rollers, at least said first friction spinning roller being perforated;

(b) means for applying suction internally of said perforated first friction spinning roller;

(c) winding means arranged to receive yarn spun in the nip between the first and second friction spinning rollers at said friction spinning station;

(d) means defining a suction slot within said at least one perforated friction spinning roller;

(e) means for opening and closing said suction slot;

(f) a fiber opening unit for opening fibers and delivering them to the nip between said friction spinning rollers, said fiber opening unit having a feed roller;

(g) means for controlling operation of said fiber opening unit; and (h) manual control means for initiating spinning operation and piecing;

the improvement wherein:

(i) the manual control means comprise a single manual control operably openably connected to the suction slot opening and closing means, and means operably interconnecting the single manual control with the winding means and the fiber opening unit in a manner that manual operation of said single manual control to initiate operation of said suction slot opening and closing means additionally initiates operation of the fiber opening unit and the winding means in the desired sequence and with a required relative timing for satisfactory piecing.

* * * * *